US009139312B2

(12) United States Patent
Jenne

(10) Patent No.: US 9,139,312 B2
(45) **Date of Patent: *Sep. 22, 2015**

(54) TIPLESS CAN FILLING VALVE

(71) Applicant: Bevcorp LLC, Willoughby, OH (US)

(72) Inventor: Richard D. Jenne, Willowick, OH (US)

(73) Assignee: Bev Corp LLC, Willoughby, OH (US)

( * ) Notice: Subject to any disclaimer, the term of this patent is extended or adjusted under 35 U.S.C. 154(b) by 204 days.

This patent is subject to a terminal disclaimer.

(21) Appl. No.: 13/942,110

(22) Filed: Jul. 15, 2013

(65) Prior Publication Data

US 2013/0299044 A1 Nov. 14, 2013

Related U.S. Application Data

(63) Continuation-in-part of application No. 12/834,886, filed on Jul. 12, 2010, now Pat. No. 8,496,031, which is a continuation-in-part of application No. 11/779,987, filed on Jul. 19, 2007, now Pat. No. 7,753,093.

(60) Provisional application No. 60/826,499, filed on Sep. 21, 2006.

(51) Int. Cl.

| | |
|---|---|
| ***B65B 3/18*** | (2006.01) |
| ***B67C 3/06*** | (2006.01) |
| ***B67C 3/26*** | (2006.01) |

(52) U.S. Cl.

CPC ... *B65B 3/18* (2013.01); *B67C 3/06* (2013.01); *B67C 3/2614* (2013.01); *B67C 2003/2657* (2013.01)

(58) Field of Classification Search

CPC ..... B60K 15/04; B67C 3/06; B67C 3/2614; B67C 3/2625; B67C 2003/268; B67C 2003/3671; B67C 2003/266; B67C 2003/2668

USPC ..... 141/57, 144–147, 285–287

See application file for complete search history.

(56) References Cited

U.S. PATENT DOCUMENTS

| | | | | | |
|---|---|---|---|---|---|
| 2,783,785 | A | * | 3/1957 | Fauth et al. | 141/48 |
| 3,067,785 | A | * | 12/1962 | Meyer | 141/57 |
| 3,209,794 | A | * | 10/1965 | Granier | 141/46 |
| 3,519,037 | A | | 7/1970 | Remane | |
| 3,534,788 | A | | 10/1970 | Trusselle | |
| 3,626,996 | A | | 12/1971 | Bingham et al. | |
| 3,683,976 | A | | 8/1972 | Remane | |
| 4,089,353 | A | * | 5/1978 | Antonelli | 141/302 |
| 4,349,055 | A | | 9/1982 | DiChíara | |
| 4,442,873 | A | | 4/1984 | Yun | |
| 4,688,608 | A | * | 8/1987 | Puskarz et al. | 141/39 |
| 4,750,533 | A | * | 6/1988 | Yun | 141/46 |
| 4,938,261 | A | | 7/1990 | Petri et al. | |
| 4,949,764 | A | * | 8/1990 | Clusserath | 141/6 |

(Continued)

*Primary Examiner* — Timothy L Maust

(74) *Attorney, Agent, or Firm* — Porter Wright Morris & Arthur, LLP

(57) ABSTRACT

A filling valve is provided for filling containers such as beverage cans. The valve includes a tipless nozzle having ports oriented for directing flow. The nozzle includes a valve seat having a planar sealing surface. A spring actuated vent seal is provided for closing the vent tube. The valve stem may have protrusions for centering the stem in the valve body. The filling valve may have a bell forming a cavity between the bell and the valve body, and an aperture for directing cleaning fluid from within the bell to the cavity. The valve body may have a duct for directing cleaning fluid from the cavity to an outlet.

14 Claims, 7 Drawing Sheets

(56) References Cited

U.S. PATENT DOCUMENTS

| | | | | | |
|---|---|---|---|---|---|
| 4,979,546 | A | | 12/1990 | LaWarre, Sr. et al. | |
| 4,986,318 | A | * | 1/1991 | Yun | 141/39 |
| 5,060,702 | A | | 10/1991 | LaWarre, Sr. et al. | |
| 5,085,255 | A | | 2/1992 | LaWarre, Sr. et al. | |
| 5,094,278 | A | | 3/1992 | Arao et al. | |
| 5,139,058 | A | * | 8/1992 | Yun | 141/40 |
| 5,141,035 | A | | 8/1992 | Nish et al. | |
| 5,150,740 | A | * | 9/1992 | Yun | 141/6 |
| 5,156,200 | A | | 10/1992 | Mette | |
| 5,190,084 | A | | 3/1993 | Diehl et al. | |
| 5,474,113 | A | | 12/1995 | Rademacher et al. | |
| 5,884,677 | A | | 3/1999 | McKaughan | |
| 5,924,462 | A | | 7/1999 | McKaughan | |
| 5,944,072 | A | | 8/1999 | Tietz et al. | |
| 5,954,100 | A | | 9/1999 | Nish et al. | |
| 5,960,838 | A | | 10/1999 | Tietz et al. | |
| 6,076,567 | A | | 6/2000 | Naecker et al. | |
| 6,082,418 | A | | 7/2000 | Naecker et al. | |
| 6,109,483 | A | | 8/2000 | Wilke et al. | |
| 6,112,778 | A | | 9/2000 | Nish et al. | |
| 6,131,624 | A | | 10/2000 | Paradies | |
| 6,135,166 | A | * | 10/2000 | Paradies et al. | 141/31 |
| 6,155,314 | A | * | 12/2000 | Ding et al. | 141/285 |
| 6,179,016 | B1 | | 1/2001 | Naecker et al. | |
| 6,223,435 | B1 | | 5/2001 | Stavrakis | |
| 6,230,767 | B1 | | 5/2001 | Nelson | |
| 6,244,309 | B1 | | 6/2001 | Martin | |
| 6,390,148 | B2 | | 5/2002 | Martin | |
| 6,397,909 | B1 | | 6/2002 | Nelson | |
| 6,484,762 | B2 | | 11/2002 | Fehland et al. | |
| 6,742,556 | B1 | | 6/2004 | Osuna et al. | |
| 7,127,870 | B2 | | 10/2006 | McRay et al. | |
| 7,287,562 | B2 | | 10/2007 | Tanikawa et al. | |
| 7,464,732 | B2 | * | 12/2008 | Nishino et al. | 141/57 |
| 7,753,093 | B2 | * | 7/2010 | Jenne | 141/287 |
| 8,006,464 | B2 | | 8/2011 | Krulitsch | |
| 8,496,031 | B2 | * | 7/2013 | Jenne | 141/286 |
| 8,695,647 | B2 | * | 4/2014 | Ruble | 141/147 |
| 2006/0283518 | A1 | | 12/2006 | Ricker | |

* cited by examiner

TIPLESS CAN FILLING VALVE

This application is a continuation in part of U.S. patent application Ser. No. 12/834,886 filed Jul. 12, 2010, which is a continuation in part of U.S. patent application Ser. No. 11/779,987, filed Jul. 19, 2007, which issued Jul. 13, 2010 as U.S. Pat. No. 7,753,093, which claims the benefit of U.S. Provisional Application 60/826,499, filed Sep. 21, 2006, the disclosures of each of which are incorporated herein by reference.

TECHNICAL FIELD

In automatic beverage filling machines, the developments relate to the filling valves associated with such machines to allow for more accurate and higher speed filling processes.

BACKGROUND

Beverage cans may be filled by automated container filling systems, wherein an empty can or other container is engaged with a filling valve, and the beverage dispenses from the filling valve into the can. One automated container filling system provides counterpressure filling, in which the can is filled with pressurized gas before the beverage is dispensed. In one counterpressure filling system, a filling valve includes a seal that expands against the top of the can, thereby sealing the inside of the can for containing pressurized gas.

In general, a plurality of cans move through a rotary filler. Empty cans are presented to the filling valve as the rotary filler turns. After the filling valve fills the can, the can moves off of the rotary filler. In valves associated with known machines, various deficiencies are found to effective and fast filling procedures. One problem noted with known valves relates to the liquid seal within the valve, which has a wedge-shaped sealing surface which contacts a wedge seal seat, wherein the liquid seal has the tendency to be frictionally engaged in a manner that causes hesitation when opening the valve, thereby causing a short fill. Further, the liquid seal seat formed in such known valves has been formed integral with the valve body, so that it is not replaceable apart from the entire valve. A further impediment to achieving desired fill time with the known valve relates to the use of a screen positioned just beneath the sealing surface to assist in stopping flow of the liquid upon valve shutoff. The position of the screen is well above the valve outlet, allowing a significant amount of liquid to continue to drip from the valve after closure, and causing delay in completion of the fill. Other delays in the filling process are found in the need to snift a significant volume of gas upon completion of the fill from the headspace in the valve. Loss of liquid contents also could occur by the liquid entering the space around a can sealing member during the fill process, and being retained in association with the valve behind the can sealing member. Additional problems with known valves are found in the manner in which liquid is directed into the can or other container. With a can, known valves direct the liquid in a spiral fashion, but introduce the liquid in a direction which is well below the top of the can. This can cause disruption in the flow of the liquid into the container as the fill height increases.

Another problem with prior valves has been their ability to fill containers in a manner to reduce foaming or for filling containers of differing sizes. For example, as it is desired to fill the container as quickly as possible, introduction of the liquid is performed with the valve fully opened, which can result in excessive foaming. Further, a valve for filling a small can may cause foaming and/or excessive fill times when used for filling a large can and vice versa. This causes lost product, or inaccurate filling, or lost production due to change-over from one valve to another to accommodate various containers. Other problems, including limitations to proper cleaning of such valves, and others, have been noted.

SUMMARY OF THE DISCLOSURE

One embodiment provides a filling valve for filling a container a valve body having a chamber, a nozzle assembly being connected to the chamber, the nozzle assembly comprising a nozzle comprising an outlet and a peripheral surface about a central axis, an expandable sealing member operably positioned around the peripheral surface without interruption for substantially preventing liquid from flowing into an area about the peripheral surface, and positioned above the outlet for sealably engaging a container, the seal being capable of being expanded by a pressurizing gas, a vent tube positioned vertically above the nozzle, at least one aperture in the nozzle assembly near the sealing member, and a fluid passageway operatively positioned for communicating pressurizing gas from the vent tube through the at least one aperture in the nozzle for expanding the sealing member.

In an embodiment, the filling valve comprises a valve body having a chamber, a nozzle connected to the valve body, a valve seat having at least one aperture connecting the valve body chamber with the nozzle, a valve stem adapted to operatively move between a valve open position and a valve closed position to control a flow of fluid through the at least one aperture, a vent tube positioned vertically above the nozzle comprising a vent seat therein, a rod operably positioned to selectively close the vent seat blocking the flow of gas through the vent tube, a cap being vertically positioned above the valve stem and vent tube and selectively contacting the valve stem, the cap comprising an aperture, an end of the rod extending there though, a valve cam being positioned above the cap, the valve cam comprising a bearing surface adapted to push the rod axially downward to close the vent seat and the cap and valve stem axially downward into the valve closed position, the valve cam further comprising a groove through a portion of the bearing surface positioned for the end of the rod to operably move upward into the groove opening the vent seat while the valve stem is in the valve closed position when the valve cam rotates on the cap.

DETAILED DESCRIPTION OF THE DRAWINGS

Figure 1:
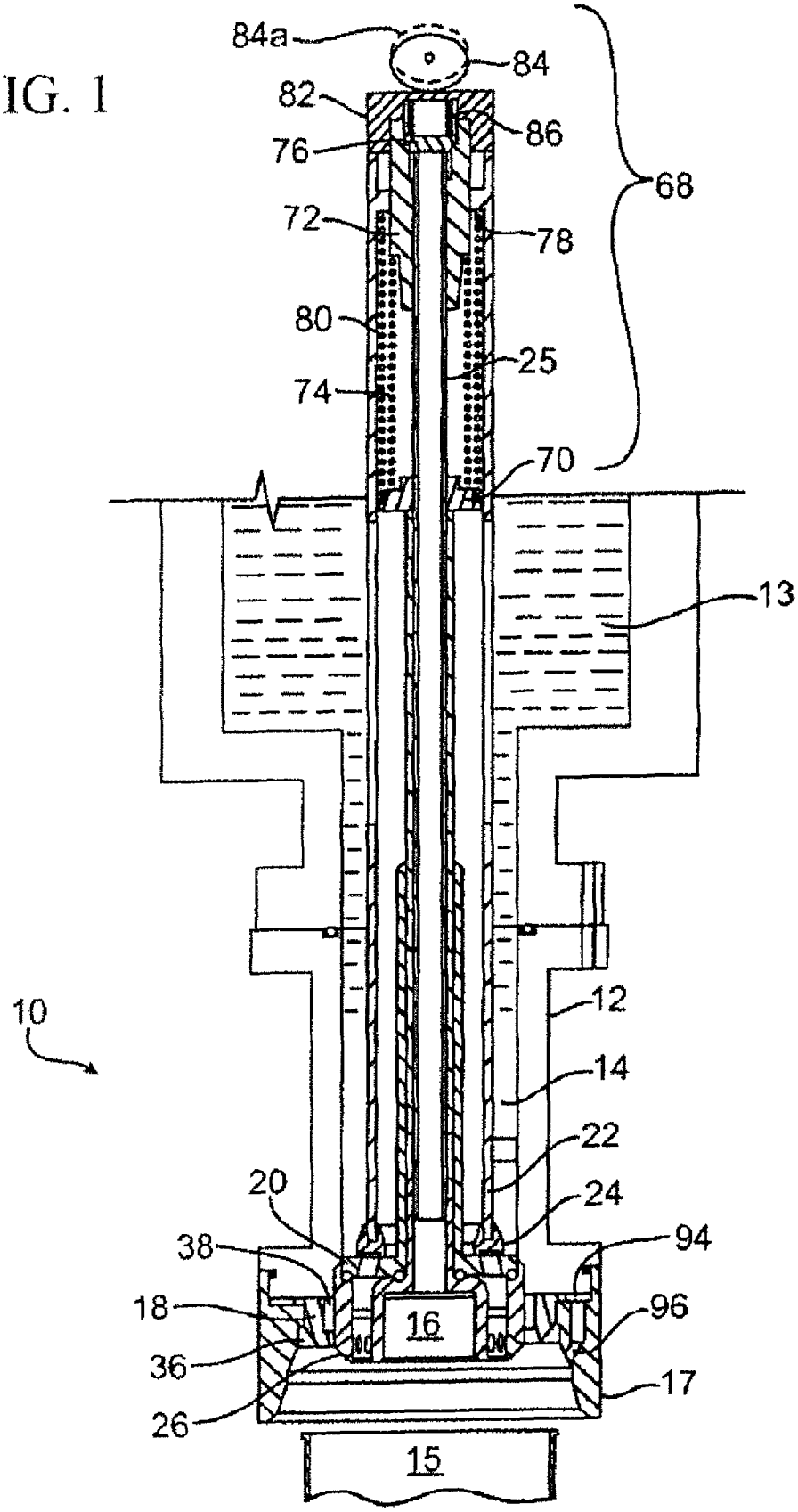
FIG. 1 is a partial cross sectional view through one embodiment of the filling valve.

The disclosure is directed to a filling valve which is generally functionally related to filling valves in widely used and long known filling machines, including but not limited to filling machines known as Crown filler machines. Turning to FIG. 1, the filling valve 10 is characterized by a generally cylindrical valve body, or housing 12, positioned with a reservoir 13 so that a liquid beverage or other fluid will selectively flow therethrough from the filling machine bowl or reservoir 13, through a nozzle assembly comprising a valve sealing seat 20 and dispensing nozzle 16, to be dispensed into a beverage can or other container 15. The filling valve embodiment of FIG. 1 further comprises a bell 17 surrounding the dispensing nozzle 16 adjacent to container sealing member 18. A valve actuation system includes the valve seat 20, a valve stem 22, and a closure valve 24, cooperating to selectively operate the filling valve 10 between a valve-open position and a valve-closed position. In the embodiment of FIG. 1, a vent tube 25 is connected to the nozzle 16 and positioned within the valve stem 22. The vent tube 25 may be of a screw in type to be selectively screwed into engagement with the nozzle 16 or otherwise suitably attached. The filling valve 10 may operate between the valve-closed and valve-open positions by the operation of an actuating assembly, generally indicated 68, which is capable of selectively opening the vent tube 25 and lifting the valve stem 22 for selective opening and closing of the valve 10.

The filling nozzle 16 is positioned at an operative end of the filling valve for directing fluid into the container 15. In one embodiment, the container is presented so that a mouth or opening on the container is beneath the nozzle 16. A container nest or conveying apparatus may lift the container into a filling position. Alternatively, the filling valve may move into the filling position. Methods and devices for presenting an empty container, such as but not limited to a can, to a filling valve are generally known in the art.

In one embodiment, the filling valve 10 is arranged in a vertical axial orientation with the chamber 14 being cylindrical about a centerline axis. In the embodiment of FIG. 1, the reservoir 13 is positioned vertically above the housing 12 such that the reservoir 13 is in fluid communication with the chamber 14. In this embodiment, the valve stem 22 extends from within the housing 12 into the reservoir. In the embodiment of FIG. 1, fluid contained by the reservoir 13 flows from the reservoir into the valve body chamber 14 and into the valve stem 22 by the force of gravity. In alternate embodiments, the chamber 14 may not be cylindrical, and it is contemplated that the valve 10 and/or chamber 14 may be angled or oriented in other non-vertical positions.

In one counterpressure filling embodiment, the reservoir 13 contains fluid and a pressurizing gas above the fluid, or in the head space of the reservoir 13. In this embodiment, shown in FIG. 1, the vent tube 25 extends above the fluid level into the pressurizing gas. The pressurizing gas may selectively flow through the vent tube 25 and into the container, causing the container 15 and the reservoir 13 to be substantially at the same internal pressure above 1 atmosphere during the filling process, discussed below.

Figure 2:
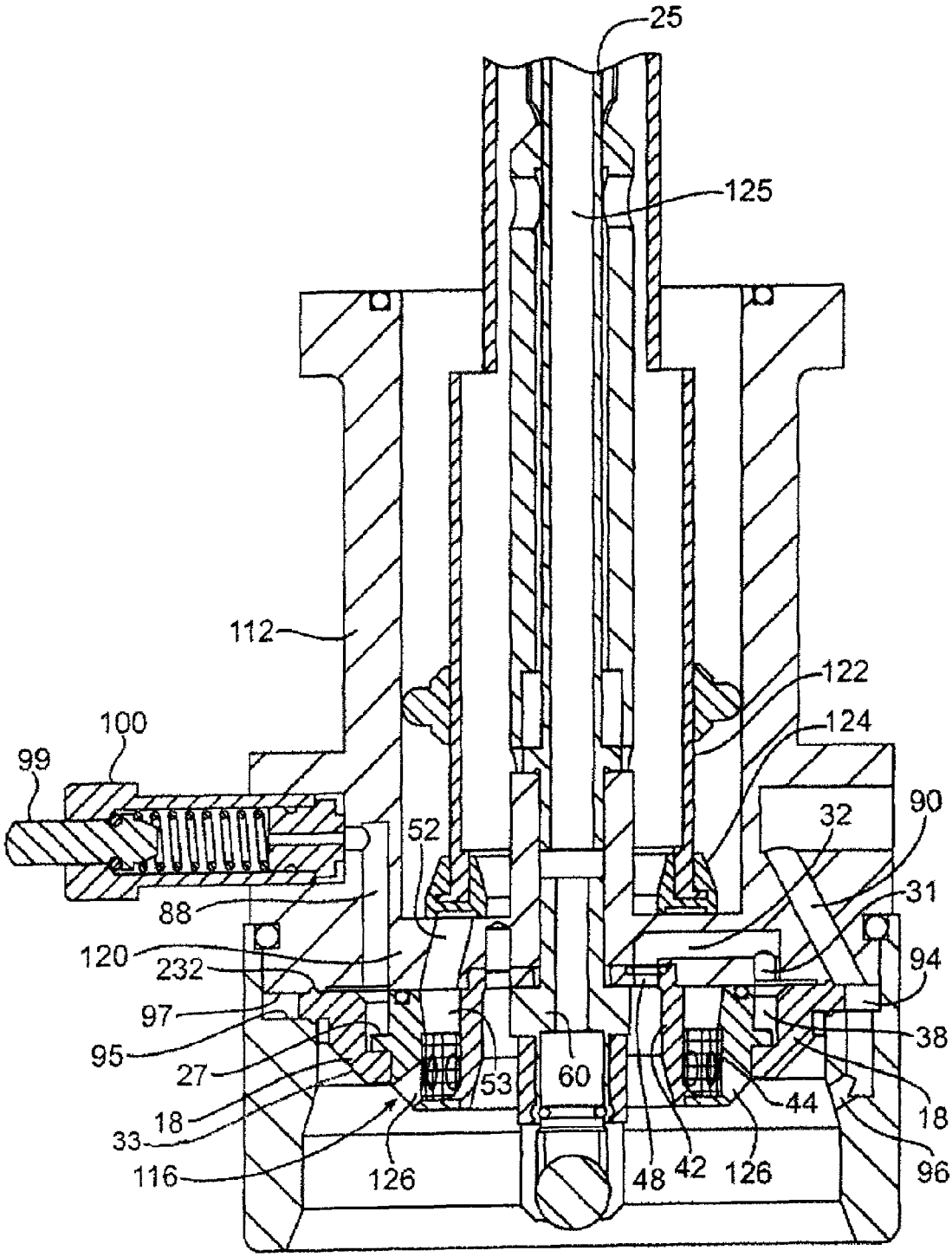
FIG. 2 is a partial cross sectional view through an alternative filling valve configuration.

With reference to FIG. 2 showing an alternative valve configuration, an empty container 15 may be lifted into a filling position having a sealing engagement with the seal 18 sufficient to hold the pressurizing gas in the container. When the empty container is provided in the filling position in sealing engagement with the seal 18, the pressurizing gas from the vent tube 25 flows through the ball cage assembly 60 into the can. As gases continue to flow, the can is filled and gas flows into port 48 to port 32 in the nozzle assembly and out port 31 to fill the seal cavity 38 and cause the seal to flex or expand into further engagement of the container sealing surface 33 with the top interior walls of the container. The expanded seal 18 provides sufficient engagement with the container to allow additional pressurizing gas to be released into the container to achieve a pressure inside the container greater than 1 atmosphere. After the container is pressurized to substantially the same pressure as the pressure in the reservoir 13, liquid from the reservoir flows into the container 15 by way of the nozzle outlet(s) 26. Referring to FIG. 2, to provide counterpressure to the can, the can bowl head space gases pass through tube 125 when the can is lifted into the seal 18. As pressure builds in the can, gases flow through inlet 48 into port 32 and out port 31. The port 31 leads to the cavity 38 formed in the can seal member 18 causing it to expand into sealing engagement on the can positioned on the valve. After filling, during the snift process, the top of vent tube 125 is sealed and snift valve button 99 of snift valve 100 is depressed. Port 88 communicates between snift valve 100 and the can seal cavity 38, via ports 31, 32, 48, the can head space, and vent tube 125, to slowly bring the filling pressure required back to atmospheric pressure.

Figure 3:
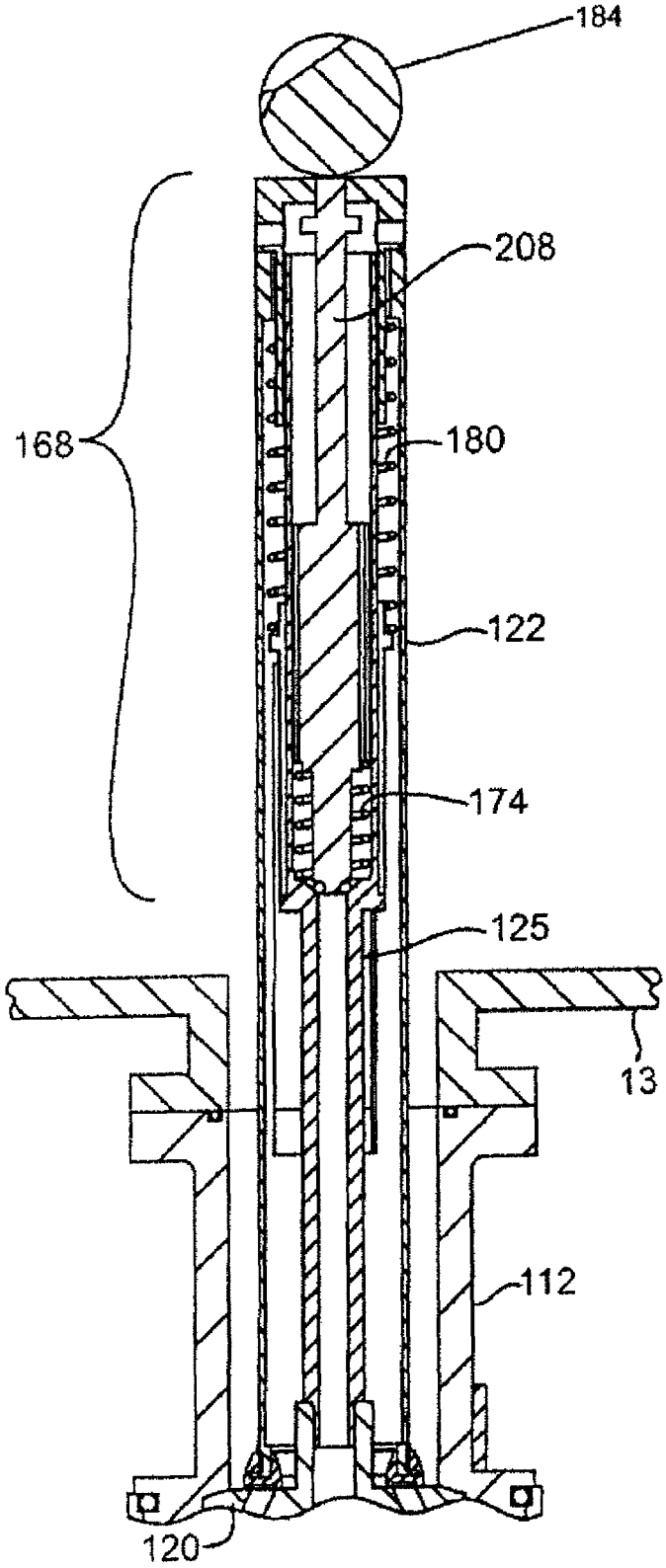
FIG. 3 is a partial cross sectional view through an alternative embodiment of the filling valve.
Figure 4:
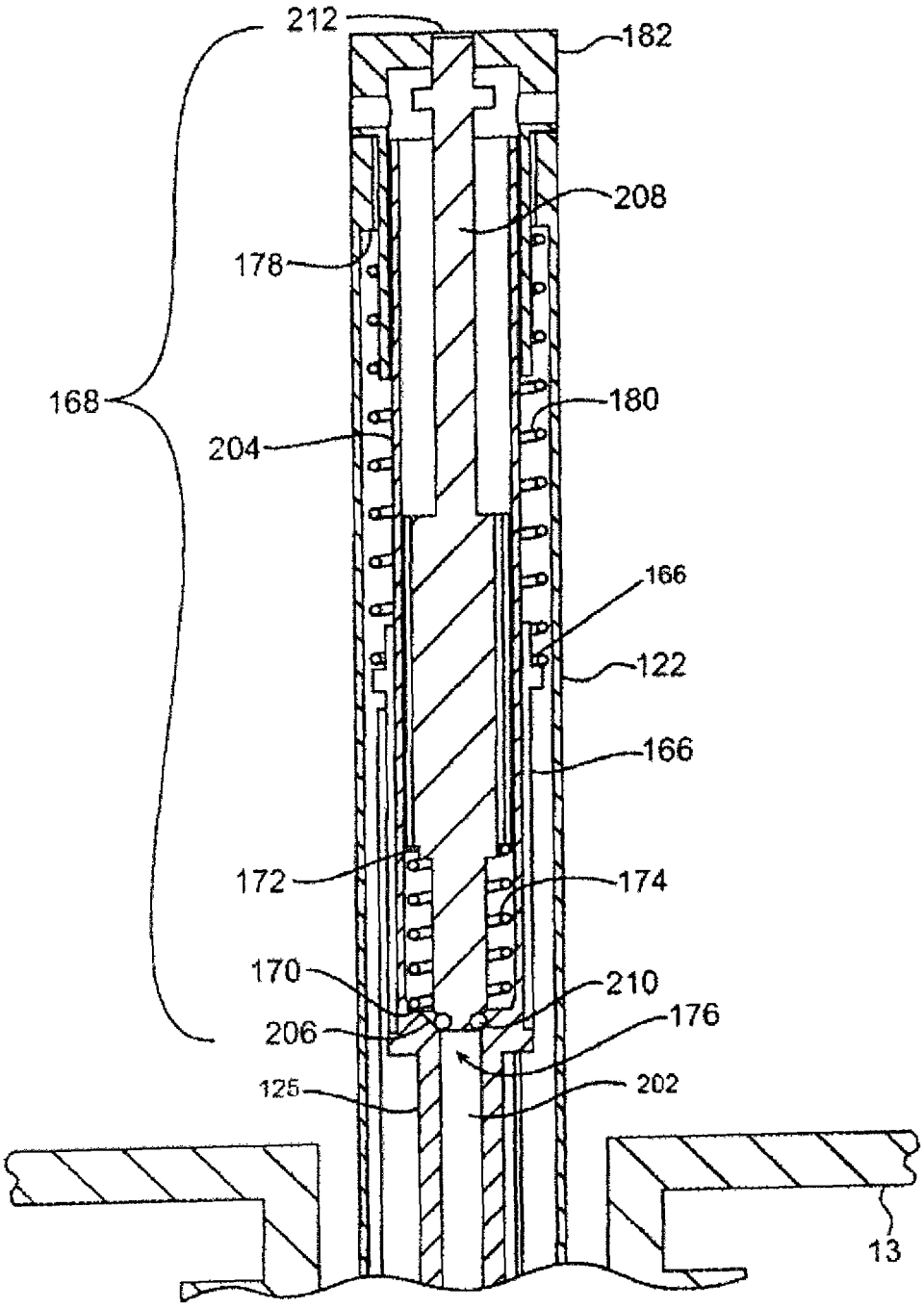
FIG. 4 is a partial cross sectional view of an alternative embodiment of an actuating system for a filling valve.

Referring now to FIGS. 3 and 4, the actuating assembly 168 comprises an arrangement of systems and associated spring biasing members to allow for variable movement between valve closed and valve open conditions as desired. In this configuration, a vent tube 125 may comprise a tube portion 202 and a pressure valve portion 204 with a vent seating surface 206 therebetween. A vent seal 176 operatively engages and disengages the vent seating surface 206 by means of o-ring 210 on rod 208 to selectively close or open the flow of gas through the vent tube. The vent tube 125 extends from a lower portion of the valve body adjacent the nozzle 16, 116 to the head space above the fluid in the reservoir 13, such that when the vent seal 176 disengages from the vent seating surface 206, the pressurizing gas in the head space of the reservoir flows through the tube portion 202 of vent tube 125 and into the container. The actuating assembly 168 may include the pressure valve portion 204 as shown in FIG. 4.

In this embodiment, the vent tube 125 is axially positioned with the valve stem 122. The valve stem 122 may comprise a stem spring seat 178 located within the valve stem. A valve spring seat 166 may be provided around the pressure valve portion 204 of the vent tube and vertically positioned beneath the stem spring seat 178. The valve spring seat 166 may be a sleeve or other part operatively positioned around the vent tube. Alternatively, the valve spring seat 166 may be integral with the vent tube 125. A valve spring 180 is operably positioned between the valve spring seat 166 and the stem spring seat 178.

Within the pressure valve portion 204 of the vent tube 125, the vent seal 176 may comprise a rod 208 and an o-ring 210 movable within the pressure valve portion 204 of the vent tube, the o-ring positioned to be capable of disengaging and engaging the vent seating surface 206 for selectively opening and closing the vent seal as the rod operatively moves within the vent tube 125. The vent tube 125 may comprise a lower spring seat 170 operably positioned around and/or adjacent the vent seating surface 206. The rod 208 may comprise a pressure spring seat 172, and a pressure spring 174 may be operably positioned between the lower spring seat 170 and the pressure spring seat 172. As shown in FIG. 4, the lower spring seat 170 and the valve spring seat 166 are in a fixed position relative to the vent seating surface 206 and the vent tube 125. In the embodiment of FIGS. 3 and 4, the rod 208 and associated pressure spring seat 172 are capable of translating in an axial direction within to the vent tube 125 for opening and closing the vent seal 176.

Figure 5:
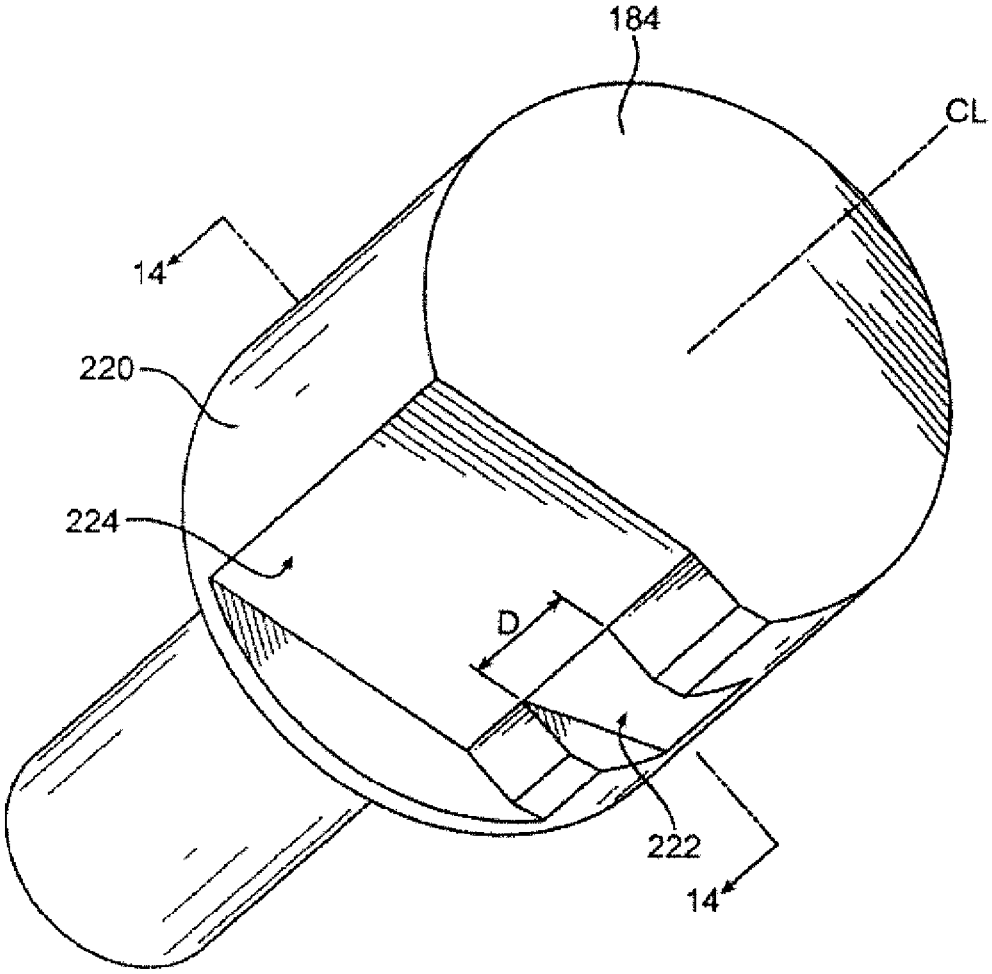
FIG. 5 is a perspective view of a cam for use with the actuating system of FIG. 12.

The actuating assembly 168 further comprises a cap 182 positioned above the valve stem 122, and a valve cam 184 capable of controlling the height of the cap 182. The cap 182 comprises an aperture 212 with the end of the rod 208 extending there through, and the end of the rod selectively engaging the cam 184. As shown in FIG. 5, the cam 184 comprises a bearing surface 220, and may comprise a groove 222 cut into the bearing surface having a width greater than the size of the end of the rod 208, identified as "d" in FIG. 5, such that the end of the rod 208 may travel along the groove in operation. The groove 222 may be positioned centrally on the bearing surface 220 such as shown in FIG. 5. Alternatively, the groove 222 may be toward the front of the bearing surface, or toward the rear of the bearing surface. In any event, the groove 222 is positioned such that the end of the rod 208 travels within the groove as the cam 184 rotates. The cam 184 further comprises a recess 224 adjacent the groove 222 for configured for actuating the valve stem 122.

Figure 6A:
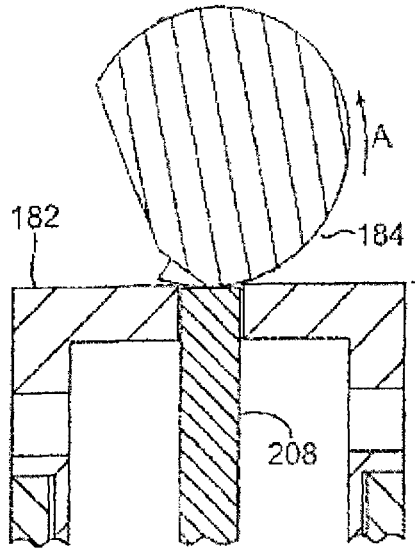
FIGS. 6*a* through 6*d* are partial sectional views through the cam and actuating system illustrating an activation sequence of a filling valve.

The cap 182 and valve stem 122 translate axially up and down between an upper and a lower position, floating against the operatively rotating valve cam 184. For example, FIGS. 6*a* through 6*d* include reference datum lines to indicate relative motion of the valve stem. In the embodiment of FIG. 5, as the cam 184 rotates, indicated by reference "a" shown in FIG. 6*a*, the bearing surface 220 holds the cap 182 and the end of the rod 208 in the valve closed position. In this position, the cam provides a downward force against the rod 208 compressing the pressure spring 174 and seating the o-ring 210 against the vent seating surface 206, closing the vent seal 176. The cam also provides a downward force against the cap 182 compressing the valve spring 180 and urging the valve stem 122 downward, holding the closure valve 124 against the valve seat 120 as shown in FIG. 7*a*, thereby closing the valve.

Figure 6B:
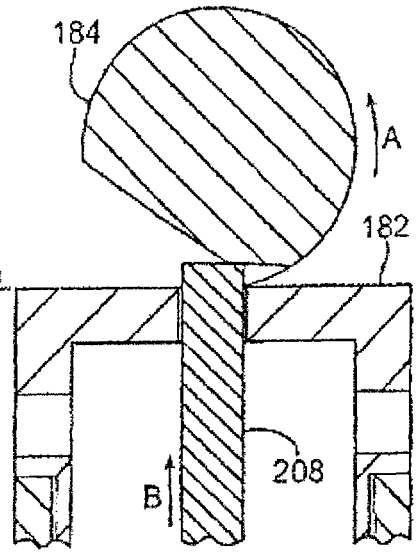
Figure 7A:
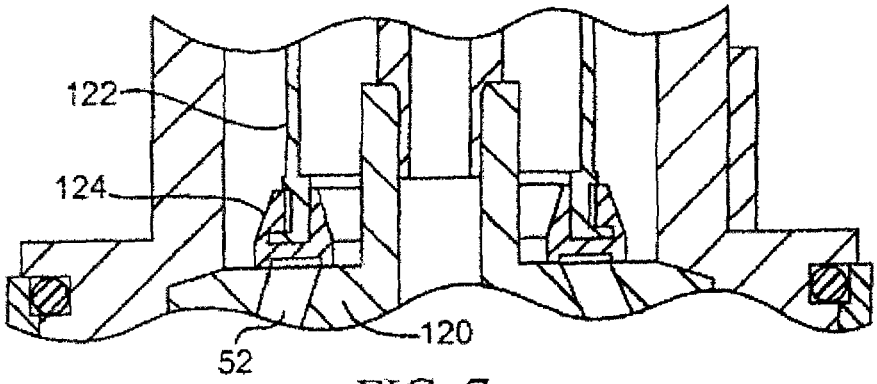
FIGS. 7*a* through 7*c* are partial sectional views through the valve seat, valve stem, and closure valve corresponding to the activation sequence of FIGS. 6*a*-6*d*.

As the valve cam 184 rotates to a counter-pressure position in FIG. 6*b*, the groove 222 passes over the end of the rod 208 enabling the pressure spring 174 to urge the rod upward into the groove to remain in contact with the cam. As the rod lifts upward, indicated by reference "b" in FIG. 6*b*, the o-ring 210 disengages from the vent seating surface 206 thereby opening the vent seal 176 and enabling pressurizing gas in the head space of the reservoir to flow through the vent tube and into the container, while the cap 182 remains in contact with the bearing surface 220 adjacent the groove 222 urging the valve stem 122 downward in the valve closed position, as shown in FIG. 7*a*. After the vent seal 176 opens, the container becomes approximately the same pressure as the head space of the reservoir 13 prior to the valve seat opening, and the can seal 18 (see FIG. 2) is expanded into engagement with the container 15.

Figure 6C:
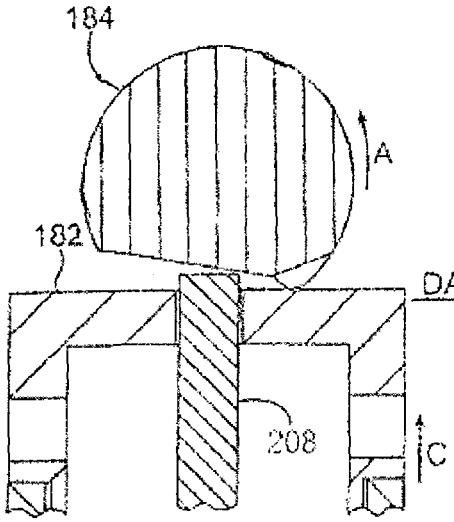
Figure 7B:
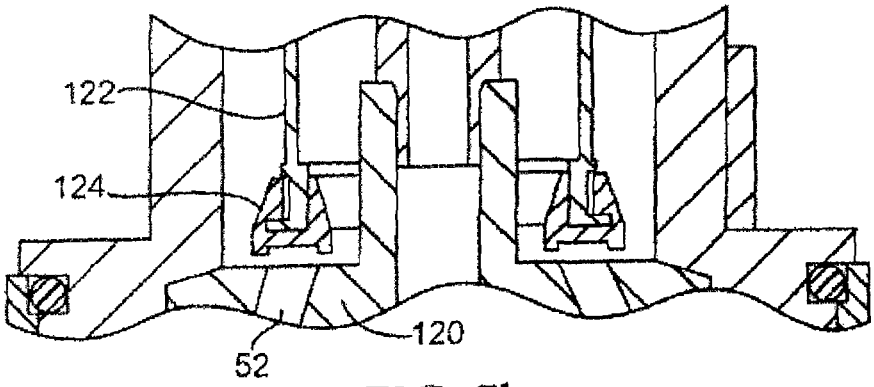

As the cam 184 continues to rotate as shown in FIG. 6*c* past the edge of the bearing surface, the vent seal 176 is closed, and the snift valve 100 (see FIG. 2) may be actuated to remove most of the gases in the container 15 prior to filling to pre-evacuate the container prior to re-pressurization and filling. As cam 184 continues to rotate, the cap begins to lift enabling the valve spring 180 to urge the valve stem 122 upward as shown in FIG. 7*b* and indicated by reference "c" in FIG. 6*c*, and the cap 182 to remain in contact with the cam. As the rod 208 of valve stem 122 lifts, the container is re-pressurized. In this state no liquid will flow, as cam 184 has to rotate far enough so cap 182 is partially off the cam high lobe 220. As the rod 208 of valve stem 122 continues to lift, liquid begins to flow from the reservoir 13 through the valve seat 120 and into the container 15 after re-pressurization. In this way, the counterpressuring of the container 15 is independent from the liquid feed operation, after the step of pre-evacuation of the container 15 once it is sealed with the valve. The edge of the bearing surface may be configured to enable a partial opening of the valve to an intermediate position during this stage of rotation of cam 184, thereby providing a reduced flow rate through the valve seat 120 and into the container to minimize any production of foam at the beginning of the fill cycle, wherein the container is empty.

Figure 6D:
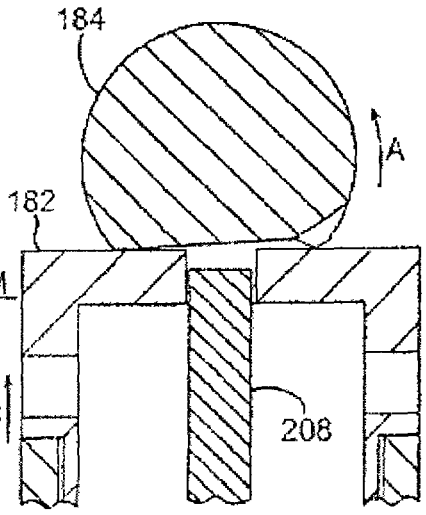
Figure 7C:
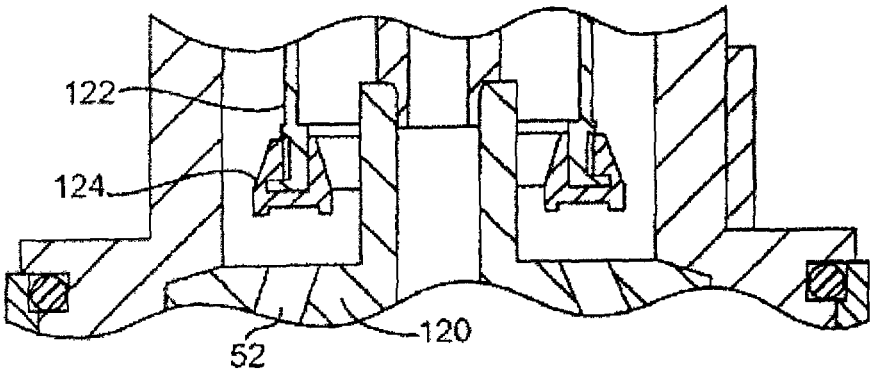

As the cam 184 continues to rotate to the raised position as shown in FIG. 6*d*, the recess 224 (see FIG. 5) passes over the cap enabling the valve spring 180 to urge the valve stem 122 and cap upward to a full-open position as shown in FIG. 7*c*, enabling the full flow rate of fluid through the valve seat 120. Reversing rotation of the cam engages the bearing surfaces 222 and 220 against the cap 182 and the end of the rod 208 to close the valve and compress the pressure spring 174 and the valve spring 180.

The cam 184 may be configured such that the intermediate position shown in FIGS. 6*c* and 7*b* provides partial filling mode or a reduced flow rate useful for inhibiting foaming action of carbonated beverages and beer as the initial flow of fluid enters the container. After fluid begins to flow in the intermediate position with reduced flow reducing foaming, the cam 184 is rotated to provide a full-open flow rate in the open position shown in FIGS. 6*d* and 7*c* providing efficient filling of the container with reduced foaming. The characteristics of the partial filling mode of operation may be altered by suitable design of the cam 184 to achieve the desired filling characteristics with a particular filling machine, beverage, or the like. Additionally, controlling the foaming caused by the initial flow into the container by using a reduced initial flow rate may enable the full-open flow rate to be increased over prior valves. It is contemplated that flow area of the orifice controlling the full-open flow rate may be increased by 50%, or may be increased by 85%, or greater over prior valves. For example, a prior orifice diameter was 0.171 inches, and it is contemplated that the orifice diameter may be increased to 0.250 inches or greater.

As the fluid level rises in the container, the volume of pressurizing gas displaced by fluid entering the container flows back through the vent tube 125 and into the reservoir 13. When the container contains a desired amount of fluid, an amount of pressurizing gas remains in the container above the fluid. After the valve cam moves to the lowered position pressing the cap 182 down and causing the valve to close, the snift valve 100 is actuated causing the pressurizing gas in the container to vent, returning the container to atmospheric pressure.

For certain beverages such as beer or other carbonated beverages, air remaining in the container when the container is initially placed into the filling position may reduce the shelf life of the beverage as the air provides a source of oxygen trapped in the container after filling. The present actuating assembly 168 and snift valve 100 may be used with a method of evacuating air from the container prior to filling. After the container is in place for filling, the cam 184 rotates to the counter-pressure position with the groove 222 passing over the end of the rod 208, enabling the pressure spring 174 to urge the rod upward in the groove to remain in contact with the cam. As the rod lifts upward, the vent seal 176 opens enabling pressurizing gas such as nitrogen or carbon dioxide in the head space of the reservoir to flow through the vent tube and into the container. The snift valve 100 may be actuated to enable a flow of gas from the container to exit the valve thereby purging a substantial amount of air from the container replacing the air with gas from the head space in the fluid reservoir 13. Then, the valve seat may be opened to enable flow of fluid into the container. The snift valve 100 may be closed before, concurrent with, or after the valve seat is opened. It may be desired to reduce the loss of fluid passing through the snift valve with the pressuring gas by closing the snift valve 100 prior to or with the opening of the valve seat.

In an alternative embodiment, the filling valve may provide a variable flow rate through the valve as desired as the valve operates between the valve-closed and valve-open positions. The actuating assembly 68 may provide, for example, a restricted flow when the valve first opens, then full flow after the fluid begins to enter the container 15.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. Additional features of the invention will become apparent to those skilled in the art upon consideration of the description. Modifications may be made without departing from the spirit and scope of the invention.

What is claimed is:

1. A filling valve for filling a container comprising:

a valve body having a chamber, a nozzle being connected to the chamber, the nozzle comprising an outlet, a valve seat having at least one aperture connecting the valve body chamber with the nozzle, a substantially planar sealing surface around the at least one aperture, a closure valve selectively engaging the sealing surface, adapted for controlling the flow of fluid through the at least one aperture the closure valve comprising a rod and an o-ring, a valve stem being adapted for operatively moving the closure valve between a valve open position and a valve closed position, a cap vertically positioned above the valve stem, the cap comprising an aperture, an end of the rod extending through the aperture, a rotatable valve cam positioned above the cap, the cam having a bearing surface, a groove and a recess, the end of the rod selectively engaging the cam, and a spring positioned between the cap and the closure valve, the spring, urging the rod upward, wherein, when the cam provides a downward force against the rod, the spring is compressed, the o-ring is seated against the sealing surface and the closure valve is closed.

2. The filling valve of claim 1, where the cap remains in contact with the bearing surface adjacent the groove to urge the valve stem downward in the valve closed position.

3. The filling valve of claim 1, where further rotation of the cam past an edge of the bearing surface causes the closure valve to close, and a snift valve is actuated to remove most of a gas in the container prior to filling to pre-evacuate the container prior to re-pressurization and filling.

4. The filling valve of claim 3, where further rotation of the cam allows the cap to begin to lift enabling a valve spring to urge the valve stem upward, while the cap remains in contact with the cam.

5. The filling valve of claim 4, whereas the rod of valve stem lifts, the container is re-pressurized, while no liquid will flow.

6. The filling valve of claim 5, where further rotation of the cam causes the cap to be partially off a high lobe of the cam, and as the vent tube rod of the valve stem continues to lift, liquid begins to flow from the reservoir through the valve seat and into the container after re-pressurization.

7. The filling valve of claim 1, where an edge of a bearing surface of the cam is configured to enable a partial opening of the valve to an intermediate position, thereby providing a reduced flow rate through the valve seat and into the container to minimize any production of foam at the beginning of a fill cycle.

8. The filling valve of claim 4, where further rotation of the cam causes the recess in the cam to pass over the cap enabling the valve spring to urge the valve stem and cap upward to a full-open position, enabling a full flow rate of fluid through the valve seat.

9. The filling valve of claim 8, where upon reversing rotation of the cam, the bearing surface is made to engage the cap and the end of the vent tube rod to close the valve and compress a pressure spring and the valve spring.

10. The filling valve of claim 1, where the valve stem comprises at least one outwardly extending protrusion for guiding the valve stem within the valve body chamber.

11. The filling valve of claim 10, where the valve stem comprises three or more protrusions positioned about the periphery of the valve stem for centering the stem in the chamber.

12. The filling valve of claim 1 wherein the cap and valve stem translate axially up and down between an upper and a lower position, and wherein the bearing surface on the cam holds the cap and the end of the vent tube rod in the valve closed position, the recess is configured for actuating the valve stem and the spring is adapted for pressing the vent seal against the vent tube for closing the closure valve when the cap and valve stem are in the valve closed position, and wherein rotation of the valve cam to a counter-pressure position causes the groove in the valve cam to pass over the end of the vent tube rod thereby enabling a pressure spring to urge the vent tube rod upward into the groove to remain in contact with the earn and cause the vent tube rod to disengage the from the sealing surface to thereby open the vent seal and cause pressurizing gas to flow through the vent tube and into the container.

13. The filling valve of claim 1, where the cam comprises an intermediate position that provides a partial filling mode or a reduced flow rate for inhibiting foaming action as an initial flow of fluid enters the container.

14. The filling valve of claim 13 wherein after the initial flow of fluid enters the container, the cam is rotated to provide a full-open flow rate.

* * * * *